US010533355B2

(12) United States Patent
Dworkin

(10) Patent No.: US 10,533,355 B2
(45) Date of Patent: Jan. 14, 2020

(54) SURFACE BOLT AND METHOD OF MAKING AND USE

(71) Applicant: Darryl R. Dworkin, Incline Village, NV (US)

(72) Inventor: Darryl R. Dworkin, Incline Village, NV (US)

(73) Assignee: DRDesigns, LLC, Incline Village, NV (US)

( * ) Notice: Subject to any disclaimer, the term of this patent is extended or adjusted under 35 U.S.C. 154(b) by 0 days.

(21) Appl. No.: 15/934,762

(22) Filed: Mar. 23, 2018

(65) Prior Publication Data

US 2019/0161997 A1 May 30, 2019

Related U.S. Application Data

(63) Continuation-in-part of application No. 15/879,290, filed on Jan. 24, 2018.

(Continued)

(51) Int. Cl.

*E05C 1/04* (2006.01)
*E05C 1/00* (2006.01)

(Continued)

(52) U.S. Cl.

CPC ..... *E05C 1/04* (2013.01); *E05B 63/06* (2013.01); *E05C 1/004* (2013.01); *E05B 2015/165* (2013.01); *E05B 2015/1664* (2013.01)

(58) Field of Classification Search

CPC ..... Y10T 292/096; Y10T 292/1014; Y10T 292/1022; Y10T 292/1023;

(Continued)

(56) References Cited

U.S. PATENT DOCUMENTS 1,256,132 A 2/1918 Hillburg
1,354,646 A 10/1920 Heintzelman (Continued)

FOREIGN PATENT DOCUMENTS

CN 205224868 5/2016
FR 2072522 A5 * 9/1971 ..... E05C 1/04
GB 191009887 7/1910

OTHER PUBLICATIONS

Defender Security U 9961 4-Inch Surface Bolt, Solid Brass, Polished Brass Finish—Barrel Bolts—Amazon.com.

(Continued)

*Primary Examiner* — Alyson M Merlino
(74) *Attorney, Agent, or Firm* — Jeffrey G. Sheldon; Katherine B. Sales; Cislo & Thomas LLP

(57) ABSTRACT

An improved surface bolt having a one-piece bolt and, in some embodiments, a one piece channel base in which the bolt is slidably mountable. In some embodiments, the channel base has first and second opposing edges with sidewalls along the edges, and each sidewall has a lip overhanging the base to define a groove or slot. The bolt has first and second opposing edges with ridges that slidably mount within the grooves. The bolt can include a handle extending from a first bolt member surface and a bumper extending from an opposed second bolt member surface and constraining sliding movement of the bolt between fastener heads or other stops extending from the channel base. Some embodiments of the bolt and channel base are made of a lightweight material such as plastic for example; and the bolt and channel base can include scoring, allowing their size to be altered at the score lines.

6 Claims, 8 Drawing Sheets

Related U.S. Application Data

(60) Provisional application No. 62/598,361, filed on Dec. 13, 2017, provisional application No. 62/592,274, filed on Nov. 29, 2014.

(51) Int. Cl.
*E05B 63/06* (2006.01)
*E05B 15/16* (2006.01)

(58) Field of Classification Search
CPC ..... Y10T 292/1024; Y10T 292/1028; Y10T 292/31; Y10T 292/314; Y10T 292/34; Y10T 292/37; Y10T 292/379; Y10T 292/388; Y10T 292/65; Y10T 292/657; Y10S 292/51; E05C 1/04; E05C 1/004; E05B 63/06; E05B 2015/165; E05B 2015/1664
See application file for complete search history.

(56) References Cited

U.S. PATENT DOCUMENTS 2,100,622 A * 11/1937 Adams ..... E05C 1/04 292/147
2,620,213 A * 12/1952 Keeler ..... E05C 1/04 292/147
2,701,734 A * 2/1955 Grossman ..... E05C 1/04 292/147
3,141,692 A * 7/1964 Behrens ..... E05C 1/04 292/147
4,021,063 A * 5/1977 Porter ..... E05C 1/04 292/148
4,121,863 A * 10/1978 Lawrence ..... E05C 1/04 292/150
4,690,445 A * 9/1987 Hartley ..... E05B 15/0205 292/147
4,746,152 A * 5/1988 Willcox ..... E05B 63/128 292/150
4,867,491 A * 9/1989 Arnold ..... E05B 13/004 292/150
4,884,421 A * 12/1989 Lindsay ..... E05B 67/383 70/129
5,352,001 A * 10/1994 Shieh ..... E05C 1/04 292/341.18
5,970,756 A 10/1999 Miller et al.
7,798,544 B1 * 9/2010 Bates ..... E05C 1/04 292/137
9,371,673 B2 6/2016 Nichol
2016/0230431 A1 8/2016 Yonekura

OTHER PUBLICATIONS

HardwareHut DEL-7FBR3, Deltana Solid Brass 7-1/16" (179mm), Flush Bolt Round Edge-Polished Brass)—www.thehardwarehut.com.
Tower Bolt Slide Door Lock 150Mm Polished Brass With Screws—www.amazon.com.
Zoo Architectural Hardware ZAB100B—150MM Surface Bolt—www.zoohardware.co.uk.
Ironmongery Direct Slide Action Flush Bolt—150 x 25mm—Polished Chrome.

* cited by examiner

SURFACE BOLT AND METHOD OF MAKING AND USE

CROSS-REFERENCE TO RELATED APPLICATIONS

This specification is a continuation-in-part of the applicant's prior U.S. non-provisional patent application entitled "Refuse Container Locking Apparatus And Method", Ser. No. 15/879,290, filed Jan. 24, 2018, which claims priority through (i) the applicant's prior U.S. provisional patent application entitled "Expanded Container Locking Apparatus And Method", Ser. No. 62/598,361, filed Dec. 13, 2007, and (ii) the applicant's prior U.S. provisional patent application entitled "Container Locking Apparatus And Method", Ser. No. 62/592,274, filed Nov. 29, 2017, all of which prior patent applications are hereby incorporated by reference in their entirety. In the event of any inconstancy, however, between any such application and this specification, this specification shall govern.

FIELD OF THE INVENTION

This specification relates generally to locking devices and more particularly to a sliding surface bolt for securing doors, lids, and cabinetry in position.

BRIEF EXPLANATION OF SOME ASPECTS OF THE BACKGROUND

Sliding surface bolts have long been used to retain doors of buildings, doors (and access panels) of cabinetry, and the like in a closed position. An example of such a sliding surface bolt is found in U.S. Pat. No. 1,354,646 issued to A. C. Heintzelman on Oct. 5, 1920. A metal bolt member is slidingly carried by a metal base. Screws penetrate two slots in the base and thread into mating threaded passages penetrating the underside of the bolt. The bolt member is thus constrained by these screws to slide back and forth between an open and a locked position. A separate metal handle is secured to the bolt member by a screw or other suitable fastener. The base is mounted on a door by yet additional screw fasteners. When the door is closed, a person may use the handle to slide the bolt member into a locked position in which the bolt member engages a strike plate mounted on a frame of the door. When the person wishes to open the door, the handle is used to slide the bolt member into an unlocked position in which the bolt member is disengaged from the strike plate, enabling the door to open.

The Heintzelman sliding surface bolt is relatively heavy and complicated, including the separate (i) metal base, (ii) metal bolt, (iii) metal handle, and (iv) compression spring components as well as (v) fastener passages formed in the underside of the metal bolt, (vi) a compression spring passage formed in the bottom of the bolt, (vii) fastener slots formed in the metal base, (viii) mounting fastener passages formed in the metal base, and (ix) at least five associated metal fasteners. The Heintzelman surface bolt is also of fixed size that cannot be altered easily by a user.

There are other types of prior art sliding surface bolts. They are typically made of multiple metal parts that are heavy, are relatively costly to manufacture, and can deteriorate if installed in locations that are exposed to weather. Many of these bolts are also relatively mechanically complex and also typically having a variety of small parts, screws, and the like that can come loose, break, or be lost entirely.

BRIEF SUMMARY OF SOME ASPECTS OF THIS SPECIFICATION

The inventor believes that he has discovered at least some of the problems and issues with prior art sliding surface bolts such as recited above.

Briefly and in general terms, some embodiments of an improved surface bolt has a one-piece plastic channel and a one-piece plastic bolt member with an integral handle.

In some embodiments, the channel comprises a base with first and second opposing edges. Sidewalls extend along the edges, and each sidewall has a lip overhanging the base to define a groove. The bolt member has first and second opposing edges, and each edge has a ridge mountable within one of the opposed grooves. The bolt member is slidable along the plastic channel, and the bolt member includes a handle, optionally formed integrally as part of the bolt member, extending from a first surface of the bolt member. The handle projects outwardly from between the opposed grooves.

In some embodiments, the bolt member has a second surface opposite the first surface, a an elongated indentation or channel is formed in the second surface, and an indentation penetrating bumper can be formed integrally with the bolt member in, or otherwise be mounted to, the second surface. A connector, such as a wood screw for example, may secure the channel to a door or other surface through an opening in the base of the channel. The connector may have a head that protrudes above the base. In use, the bolt member can slide along the channel within the indentation in the second surface clearing the head of the connector until the bumper strikes the connector. This can prevent the bolt member from sliding further and thereby limits its motion.

Some instances provide a bumper that protrudes from the second surface of the bolt member to abut the opposed channel and, through friction force as result of such abutting contact, provide resistance to undesired movement of the bolt member with respect to the opposed channel.

Some embodiments use two connectors to secure the channel in position. In these embodiments the bolt member is positioned so that the bumper is confined between the two connectors, constraining the bolt member to a limited range of motion. This may be done, for example, by installing one of the connectors, sliding the bolt member into the channel until the bumper hits that connector, and then installing the second connector. At one extremity of the motion of the bolt member, one of the connectors is exposed, and at the other extremity, the other connector is exposed.

In some embodiments, one or both of the bolt member and the channel have complementary scorings or slots formed in them, such as in their out peripheries. These scorings may be used as cutting guides for a saw or other cutting tool to cut the channel and/or the bolt member to a desired length. In some embodiments the scorings are deep enough that the desired portion of the channel and/or bolt member may be snapped off without need of a cutting tool.

In some instances, the bolt and mating bolt mounting channel are made of a lightweight material such as plastic or composite material. In some instances: the bolt and integral handle and bumper are injection molded to from a single, unitary component; and the bolt mounting channel can be extruded and punched.

There are other novel features and aspects that will become apparent as this specification proceeds. The scope of the invention is to be determined solely by the claims as issued, not by whether the claimed subject matter solves any particular problem, provides any particular feature, or meets any particular object set forth in the Background or Summary sections above.

BRIEF DESCRIPTION OF THE DRAWINGS

The preferred and other embodiments are disclosed in the accompanying drawings, in which.

DETAILED DESCRIPTION

Figure 1:
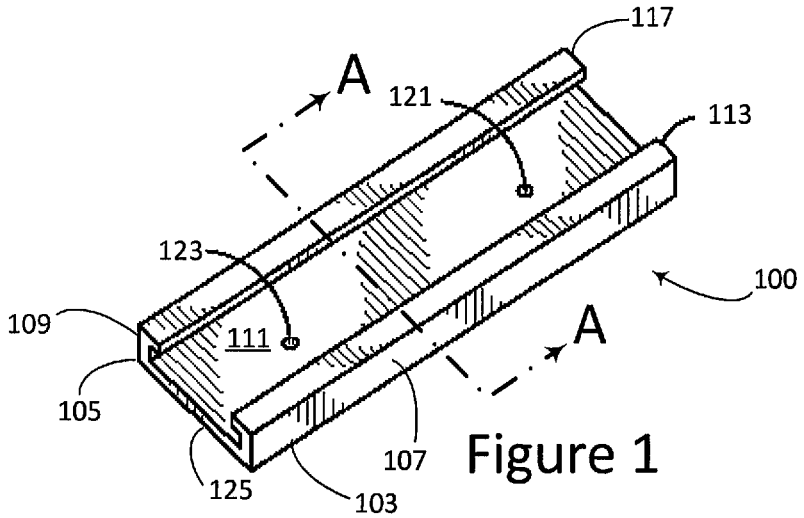
FIG. 1 is a perspective view of a channel according to an embodiment of an improved surface bolt.
Figure 1B:
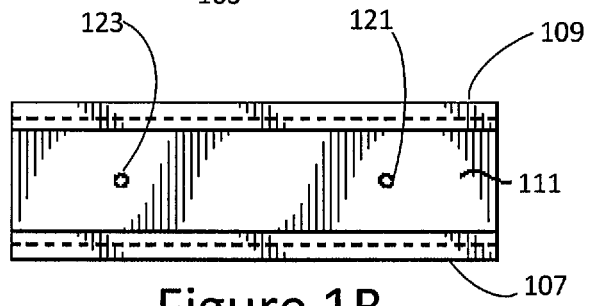
FIG. 1B is a top view of the channel of FIG. 1.
Figure 1A:
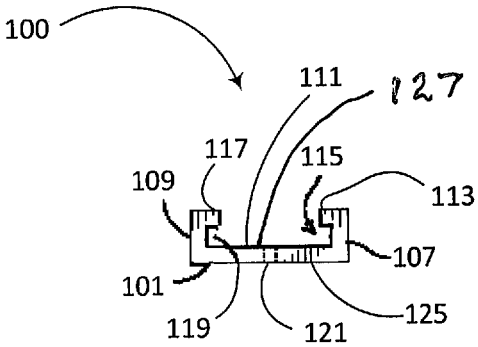
FIG. 1A is a section view taken along the line A-A of FIG. 1.

An embodiment of an improved surface bolt of this specification includes a one-piece plastic bolt mounting channel 100 as shown in FIGS. 1, 1A, and 1B. The channel 100 includes a generally planar base 101 intermediate first and second opposing edges 103, 105 extending laterally along the base 101. A first sidewall 107 extends transversely from the first edge 103, and a second sidewall 109 extends transversely along the second edge 105. The base 101 has a planar inner surface 111 extending between the first and second sidewalls 107, 109. The first sidewall 107 has a lip 113 spaced from, and parallel to, the inner surface 111 and that overhangs the base 101 and defines a first bolt mounting groove or slot 115 between the base 101 and the lip 113 of the first sidewall 107. The second sidewall 109 has a lip 117 spaced from, and parallel to, the inner surface 111 and that overhangs the base 101 and defines a second bolt mounting groove or slot 119 between the base 101 and the lip 117 of the second sidewall 109. As shown in FIG. 1A, the bolt mounting channel 100 thus provides a bolt mounting slot 115 that has an inverted T-shape within the interior periphery 127 of the bolt mounting channel 100.

In some embodiments, the base 101 includes at least two fastener openings. As shown in the Figures, the base 101 can comprise a first fastener opening or passage 121 extending transversely to, and from, the inner surface 111 of the base 101, through the base 101, to penetrate the opposed planar external surface 125 of the base 101. A screw or other fastener (not shown in FIGS. 1, 1A, and 1B) may be inserted through the passage 121 to mount the channel 100 on a door or other surface. In some embodiments, a second fastener opening or passage 123 also extends transversely to, and from, the inner surface 111 through the base 101 to penetrate the opposed external surface 125 and may be used in like manner for a fastener to mount the channel 100.

Figure 2:
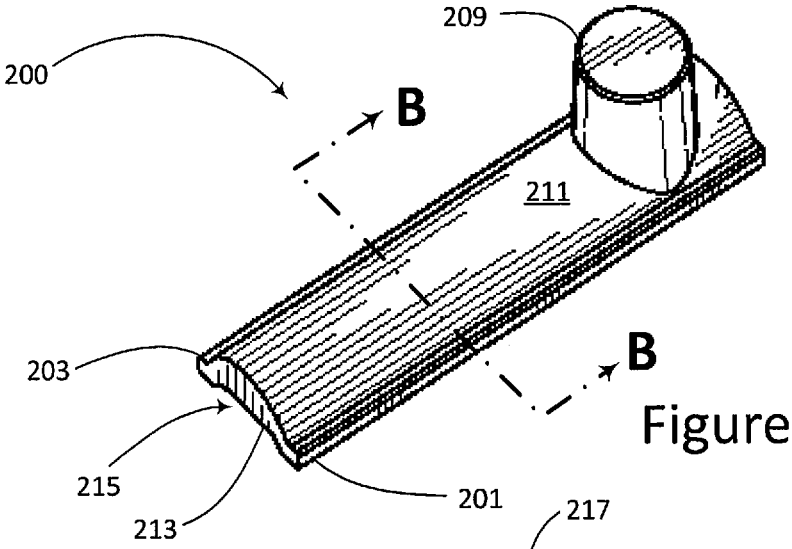
FIG. 2 is a perspective view of a bolt member according to an embodiment of an improved surface bolt.
Figure 2B:
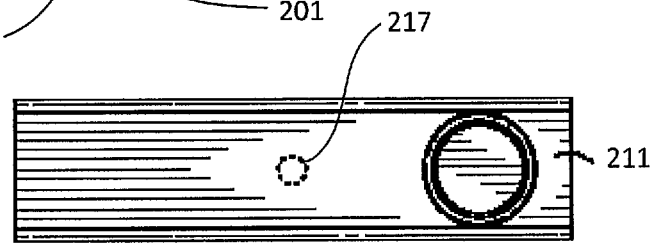
FIG. 2B is a top view of the bolt member of FIG. 2.
Figure 2C:
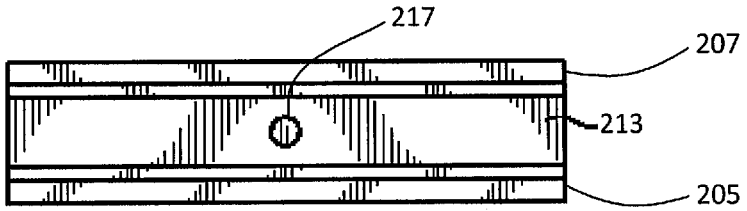
FIG. 2C is a bottom view of the bolt member of FIG. 2.
Figure 2A:
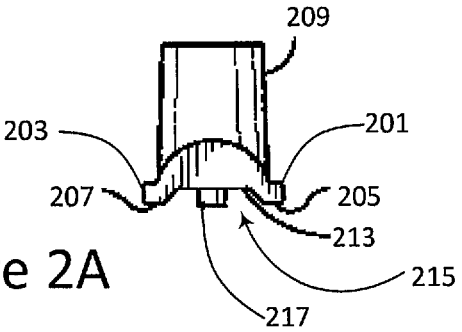
FIG. 2A is a section view taken along the line B-B of FIG. 2.

Turning now to FIGS. 2, 2A, 2B, and 2C, a one-piece plastic bolt member 200 has first and second opposed edges 201, 203. As shown in FIGS. 2 and 2A, in some embodiments the first surface 211 of the bolt member 200 may be generally semicircular in cross-section. The bolt member 200 also has a second surface 213 opposite the first surface 211. The second surface 213 may define an elongated bolt stop channel or indentation 215 penetrating the bolt member 200 laterally extending along the length of the bolt member 200. In some embodiments, a bolt bumper 217 projects from the second surface 213 of the bolt member 200 into the elongated, laterally extending indentation 215.

With reference to FIGS. 2, 2A, 2B, and 2C, the bolt member 200 can have a first planar bolt mounting ridge 205 extending laterally along the first edge 201 and shaped to slidably mount within, and matingly abut, the first bolt mounting groove 115 in the bolt mounting channel 100 (115 and 100 not shown in FIGS. 2, 2A, 2B, and 2C). The bolt member 200 can also have second ridge 207 extending laterally along the second edge 203 and shaped to slidably mount within, and matingly abut, the second bolt mounting slot 119 in the bolt mounting channel 100 (119 also not shown in FIGS. 2, 2A, 2B, and 2C).

Figure 3:
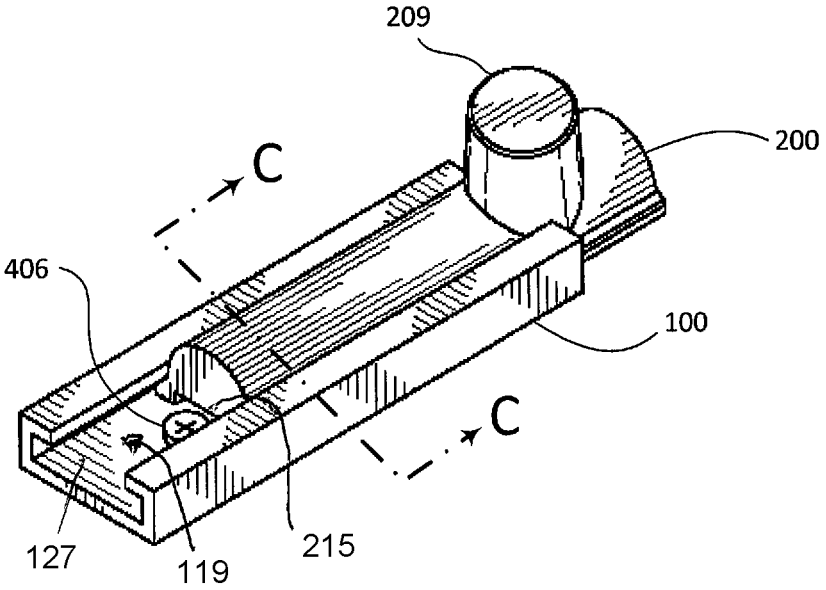
FIG. 3 is a perspective view of an embodiment of an improved surface bolt.
Figure 3A:
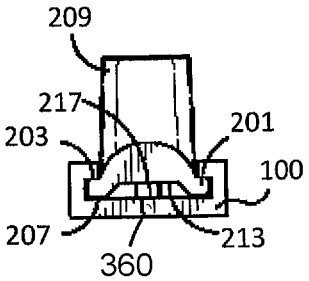
FIG. 3A is a section view taken along the line C-C of FIG. 3.

The bolt member 200 has a hand-grippable, rod-shaped handle 209 projecting from the rounded first surface 211 in the laterally-extending, thickened central bolt body 219 intermediate and extending between the thinned (as compared to the thickened central bold body 219) and opposed first mounting ridge 205 and second mounting ridge 207 in the bolt member 200. As shown in FIGS. 3 and 3A, the bolt member 200 is thus slidably mountable within the inverted-T-shaped bolt mounting slot 115 within the interior periphery 127 of the bolt mounting channel 100 (115, 127, and 100 not shown in FIGS. 2, 2A, 2B, and 2C). When mounted within the channel, the bolt handle 209 thus protrudes from the inverted-T-shaped bolt mounting slot 115 within the interior periphery 121 of the bolt mounting channel 100 the channel 100 and may be easily gripped operated by a person to slide the bolt member 200 either direction within and laterally along the mounting slot 115 within the interior periphery 121 of the bolt mounting channel 100.

Figure 4:
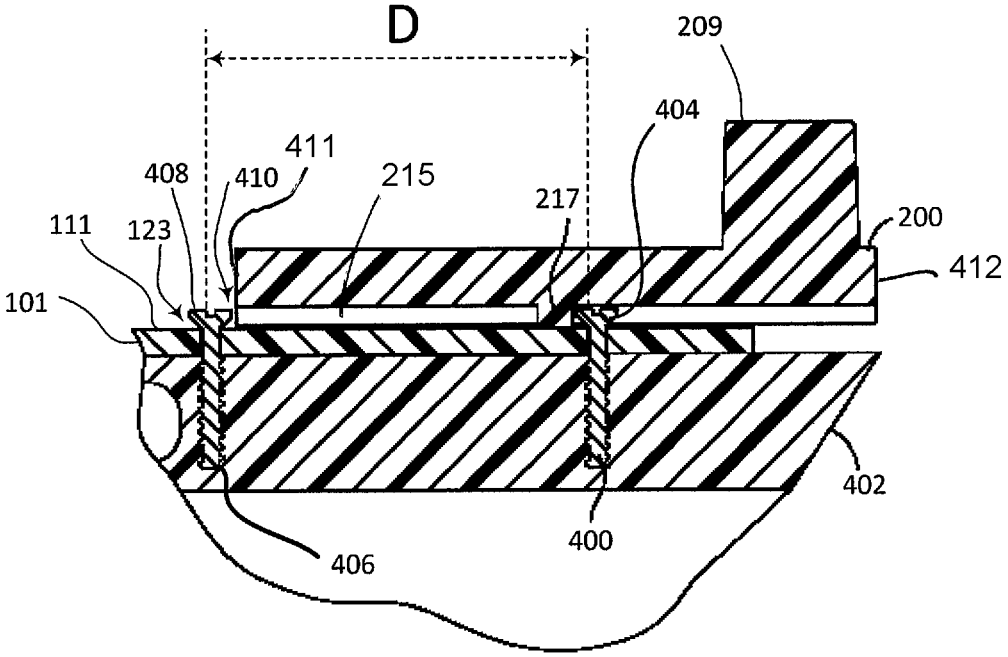
FIG. 4 is a cutaway view of a portion of an improved surface bolt and a surface on which the improved surface bolt is mounted.

Referring now to FIGS. 3 and 4, a first mounting connector or fastener (for example, a threaded screw) 400 (not shown in FIG. 3) is shaped to fit and, for example, matingly thread, within the mounting channel's first fastener passage 121 may be used to mount the base 101 of the channel 100 to a supporting surface 402. The fastener 400 has a head or stop 404 protruding above the inner surface 111 of the base 101 into the bolt stop channel or indentation 215 laterally extending along the bolt member 200. This protruding head 404 can thus block the bolt bumper 217 from moving laterally past the protruding head 404 and thereby limits the motion of the bolt member 200 to prevent a person from inadvertently sliding the bolt member bolt bumper 217 past the stop 404 completely out of the bolt mounting channel 100.

In some embodiments, a second connector or fastener 406 with a protruding head 408 is shaped to fit within a second mounting channel opening or passage 123 to secure the base 101 of the channel 100 to a supporting surface or structure 402. The protruding heads 404, 408 of the connectors 406, 400, respectively, define therebetween a limited space 410, under and within the indentation 215 in the bolt member 200, in which the bumper 217 is constrained to remain within the limited space 410 as the bolt is moved back and forth within the inverted-T-shaped bolt mounting slot 119 within the interior periphery 127 of the channel 100. The fastener passages 121, 123 are spaced apart by a distance D (for example, 1.1 inches), which is somewhat longer than the distance (for example, 0.8 inches) between the bumper 217 and either of the opposed ends 411, 412 of the bolt member 200, so that, when the bolt member 200 is moved to the limit of its motion in one direction, one among the two fasteners 400, 406 is accessible through the channel 100, and when the bolt member 200 is moved to the limit of its motion in the opposite direction, the other of the two fasteners 400, 406 is accessible through the channel 100, for convenience in mounting or dismounting the channel 100.

In some embodiments, the bolt member's bumper 217 is sized to extend to, and sufficiently abut, and thereby create sufficient predetermined friction contact with, an opposed portion 300 of the channel 100 when the bolt member 217 is mounted within the channel 100. The friction force resulting from such abutting contact can provide a predetermined level of resistance to undesired movement of the bolt member 200 with respect to the opposed channel 100.

Alternatively, a spring (not shown) or other sufficiently strong and resilient structure (not shown) can be added or substituted in the place of the bumper 217, such as by mounting of the spring or other structure in a mounting passage (not shown) in the bolt member 217. In some embodiments, the spring or other structure may be mounted to surround an exposed portion of the bumper 217. The spring or other structure can also be sized to extend to, and sufficiently abut, and thereby create sufficient predetermined friction contact with, an opposed portion 300 of the channel 100 when the bolt member 217 is mounted within the channel 100.

Figure 5:
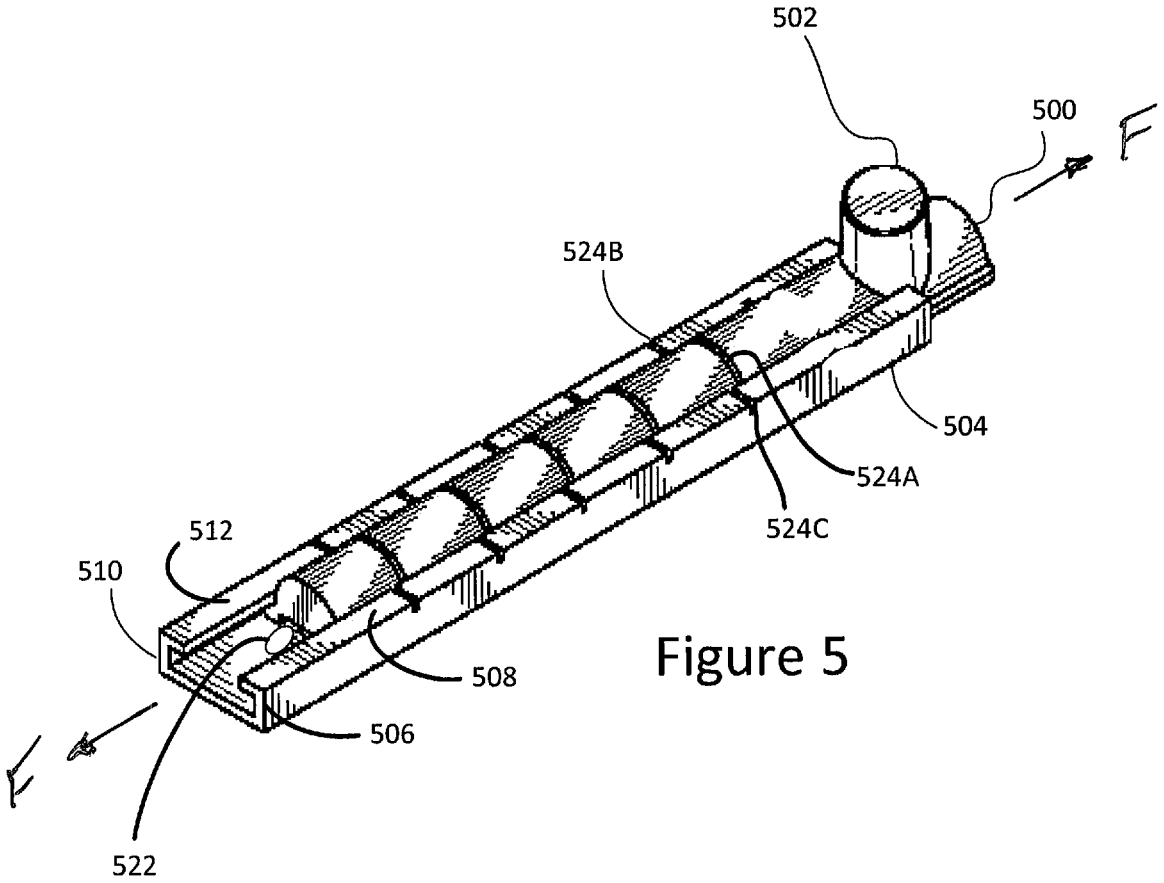
FIG. 5 is a perspective view of another embodiment of an improved surface bolt with scorings.
Figure 6:
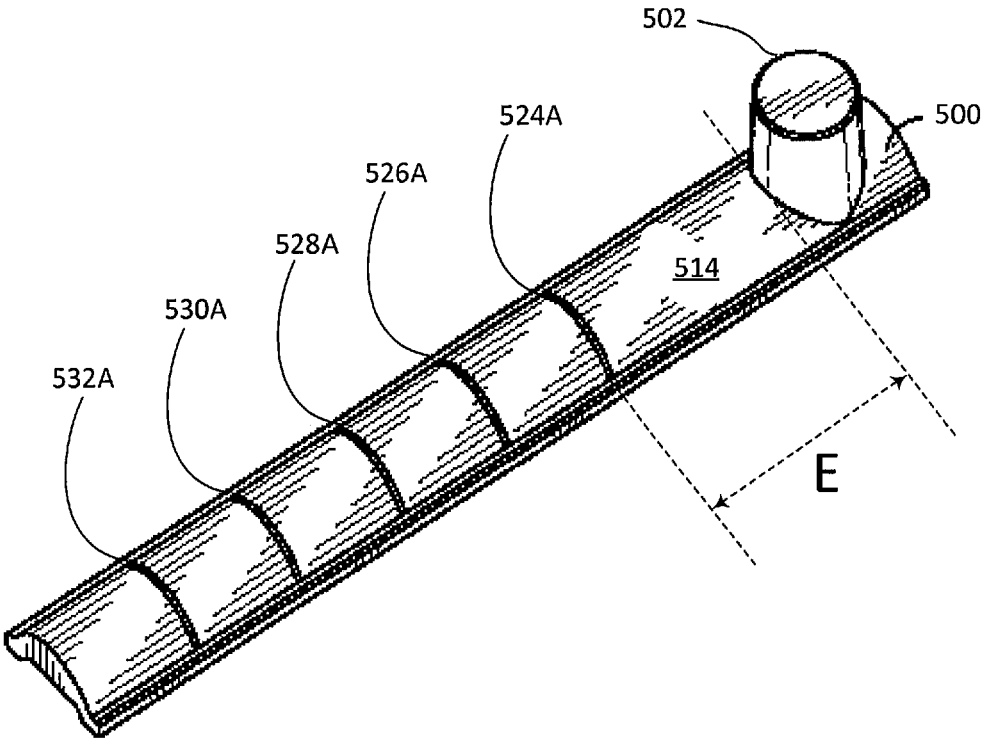
FIG. 6 is a perspective view of a bolt member of the embodiment of FIG. 5.
Figure 7:
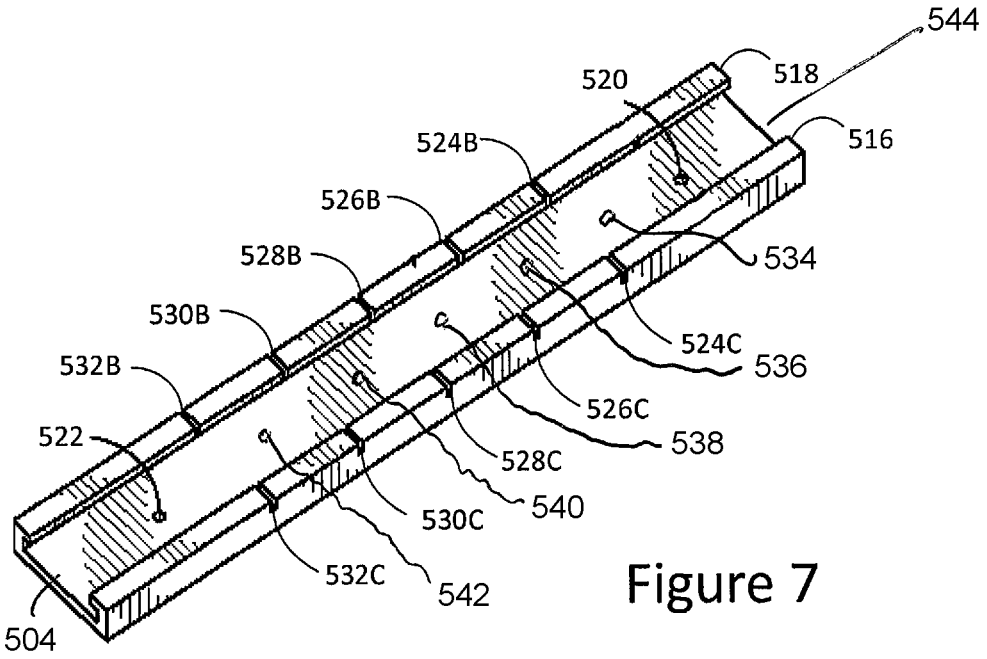
FIG. 7 is a perspective view of a channel of the embodiment of FIG. 5.

Another embodiment is shown in FIGS. 5, 6, and 7. This embodiment includes a bolt member 500 with a handle 502 generally similar to the bolt member 200 and handle 209 as previously described, and a channel 504 with a first sidewall 506 having a first lip 508 and an opposed sidewall 510 having an opposed lip 512 generally similar to the channel 100, sidewalls 107, 109, and lips 113, 117 as previously described. The bolt member 500 has an upper surface 514, the first lip 508 has an upper surface 516, and the opposed lip 512 has an upper surface 518. Fastener passages, e.g., 520, 522, penetrate the axial center (along its lateral length) of the channel 504 for mounting the channel 504 to a door or other surface.

The curved upper surface 514 of the bolt member 500 includes a plurality (five in the case of the depicted embodiment) of parallel, curved, spaced-apart slotted scores 524A, 526A, 528A, 530A, and 532A transverse to the axis F-F of the bolt member 500. The upper surface 516 of the channel's first lip 508 includes and a plurality of complementary, parallel, linear, spaced-apart slotted scores 524C, 526C, 528C, 530C, and 532C, and similarly, the upper surface 518 of the opposed lip 512 includes a plurality of similarly complementary, parallel, linear, spaced-apart scores 524B, 526B, 528B, 530B, and 532B. The first scoring 524A on the bolt member 500 may be a distance E, for example 2 inches, from the handle 502. Thereafter the scorings, e.g., 524C, 526C, 528C, 530C, and 532C, may be spaced apart from each other at any convenient distance, such as 1 inch for example. In some embodiments the channel 504 and bolt member 500 are provided in identical lengths, such as 8 inches for example.

The curved scores, e.g., 524C, 526C, 528C, 530C, and 532C, may be used as cutting or size-reducing guides to reduce the lengths of the channel 504 and bolt member 500 to desired length, and in the case of cutting, the cutting may be accomplished with a saw or some other cutting tool for example. In some embodiments, all the curved scores e.g., 524C, 526C, 528C, 530C, and 532C, can be 0.02 inches deep, for example. In some embodiments, the curved scores are deep enough to allow a user to manually break the applicable channel 504 or bolt member 500 at the desired score without any need for cutting tools. An additional five fastener passages 534, 536, 538, 540, 542 (one for each score line, e.g., 532C, spaced laterally from the score line, e.g., 532C, toward the backside 544 of the channel 504) similarly penetrate the axial center extending along the lateral length of the channel 504.

Figure 8A:
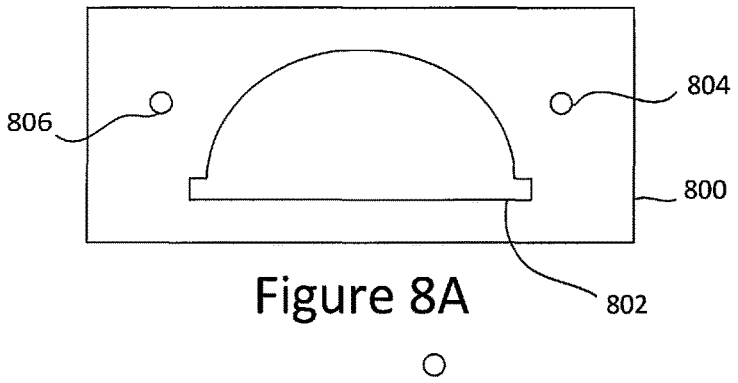
FIG. 8A is a plan view of short mount strike plate or hasp useable on, as an example, the upper or lower inner ledge of a cabinet where the surface bolt can be mounted on the cabinet door.

Any of various strike plates or hasps may be used with the improved surface bolt. For example and not by way of limitation, FIG. 8A shows a horizontally-oriented hasp 800 such as for mounting on, for example, a fixed surface of a dual door cabinet (not shown), in which (i) a first door is securable with an internal surface bolt onto either the top or bottom of the cabinet and (ii) the second door is securable to the first door with a cabinet lock. This hasp 800 has a central bolt member opening or passage 802 transversely passing through the strike plate 800 and shaped to receive a bolt member (not shown in FIG. 8A) such as the bolt members 200 or 500, and fastener openings or passages 804, 806 on laterally opposed sides of the central bolt member opening 802 for mounting the hasp 800 with fasteners (not shown) penetrating the fastener openings 804, 806.

Figure 8B:
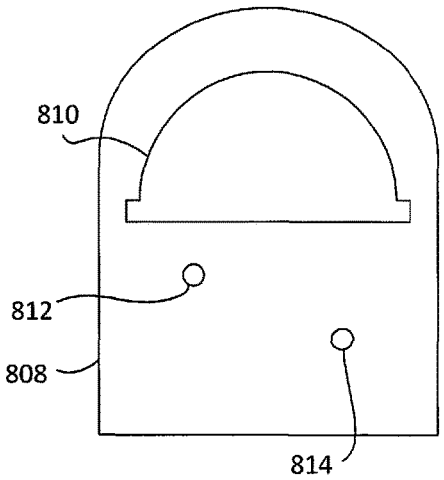
FIG. 8B is a plan view of a long mount strike plate or hasp useable for, as an example, an exposed or outer mount surface bolt where a cabinet door may close and the surface bolt may then secure the door in a closed position.

FIG. 8B shows a differing vertically-oriented hasp 808 such as for, as an example, mounting on the end of a cabinet door (not shown) with a surface bolt (not shown in FIG. 8B) mounted to other structure (not shown) to penetrate the hasp passage 810. This hasp 808 has space-apart fastener openings 812, 814 below the central bolt opening 810 for mounting the strike plate 808 to an adjacent mounting surface (not shown).

Figure 8C:
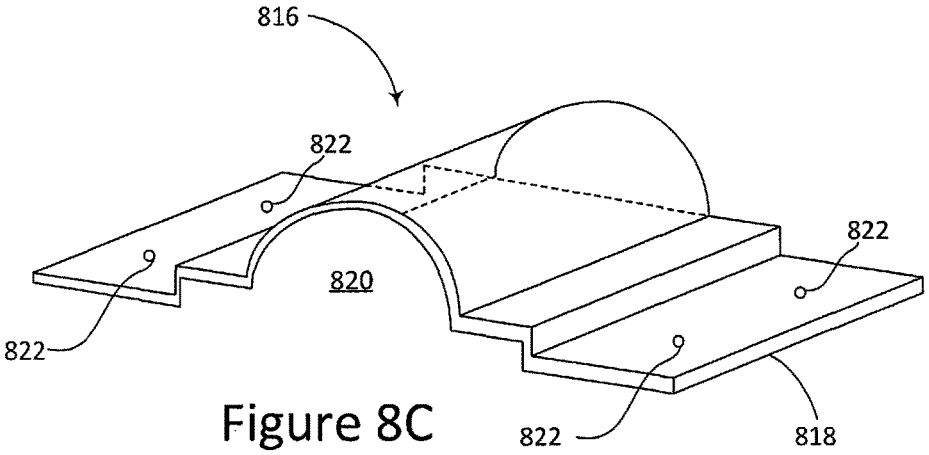
FIG. 8C is a perspective view of a cover plate or hasp useable with, as an example, either an interior or exterior surface bolt slideable into this hasp to close or secure other structure in position with respect to this hasp.

FIG. 8C shows a channeled-housing or cover plate type of hasp, generally 816, that can provide a more aesthetic hasp/bolt interlocking structure. The hasp 818 can consist of plastic, metal, or other suitably rigid material and can be formed (such as by molding or stamping as desired and applicable) to define an enclosure 820 that accommodates a mating surface bolt member (not shown in FIG. 8C). A plurality of mounting holes or passages 822 are provided for mounting the strike plate 816 to an adjacent structure surface (not shown).

The various depicted components, e.g., the bolt, bolt mounting channel, and strike plate, and fasteners, may be made of any suitably rigid materials. Some embodiments of the bolt, bolt mounting channel, and strike plate may each be made of a lightweight and easily molded and cut plastic, such as HDPE or nylon plastic for example. In the latter case, the combined bolt, bolt mounting channel, and strike plate can weigh from 0.50 ounce for the FIG. 4 embodiment, to 1.25 ounces for the 5 embodiment. Some embodiments may include coloring of the plastic or other colorable material; alternatively or in addition, the plastic or other material, such as certain metal or composite, may be suitable for painting.

The term "laterally extending" means that the referenced component or feature has a lateral length at least 50% greater than the width of the component or feature.

All dimensions herein or in the Figures can be varied for varying circumstances, uses, and objects. They may be varied by ranges of plus or minus 0.01% through up to 1000% or even higher—also with the ranges in some embodiments varying by differing amounts for differing components.

The process parameters, functions, system features, and sequence of steps described and/or illustrated herein are given by way of example only and may be varied and mixed and matched as desired. The various exemplary methods described and/or illustrated herein may also omit one or more of the steps described or illustrated herein or include additional steps in addition to those disclosed.

The foregoing detailed description has described some specific embodiments. However, the illustrative discussions above are not intended to be exhaustive or to limit the invention to the precise forms disclosed. Many modifications and variations are possible in view of the above teachings. The embodiments were chosen and described in order to explain the principles of the present systems and methods and their practical applications, to thereby enable others skilled in the art to best utilize the present systems, their components, and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C).

Unless otherwise indicated, all numbers or expressions, such as those expressing dimensions, physical characteristics, and the like, used in the specification (other than the claims) are understood to be alternately modified in all instances by the term "approximately." At the very least, and not as an attempt to limit the application of the doctrine of equivalents to the claims, each numerical parameter recited in the specification or claims which alternately modified by the term "approximately" should at least be construed in light of the number of recited significant digits and by applying ordinary rounding techniques.

I claim:

1. An improved surface bolt consisting essentially of:

a one-piece base channel having a base with first and second opposing edges, a first sidewall extending along the first edge, and a second sidewall extending along the second edge, the base having an outer surface and an inner surface between the first and second sidewalls, the first sidewall having a lip that overhangs the base and defines a first groove between the base and the lip of the first sidewall, and the second sidewall having a lip that overhangs the base and defines a second groove between the base and the lip of the second sidewall, the base channel comprising a first opening extending from the inner surface of the base through the base to the outer surface of the base;

a one-piece bolt having first and second opposing edges, a first ridge extending along the first edge and shaped to fit within the first groove, a second ridge extending along the second edge and shaped to fit within the second groove, whereby the bolt is slidable back and forth along the base channel when its first and second ridges are engaged within the first and second grooves, respectively, the bolt having a first surface and a second surface, wherein an integral handle projects from the first surface of the bolt, the second surface of the bolt being positioned opposite the first surface of the bolt and defining a bolt channel having an integral bumper projecting from the second surface; and a first connector shaped to fit within the first opening and adapted to secure the base to a supporting surface, and the first connector having a head that projects above the inner surface of the base into the bolt channel for engaging the bumper for limiting the sliding of the bolt along the base channel.

2. The improved surface bolt of claim 1, wherein both the bolt and the base channel are made from plastic.

3. An improved surface bolt consisting essentially of:

a one-piece base channel having a base with first and second opposing edges, a first sidewall extending along the first edge, and a second sidewall extending along the second edge, the base having an outer surface and an inner surface between the first and second sidewalls, the first sidewall having a lip that overhangs the base and defines a first groove between the base and the lip of the first sidewall, and the second sidewall having a lip that overhangs the base and defines a second groove between the base and the lip of the second sidewall, the base channel comprising at least two openings, each extending from the inner surface of the base through the base to the outer surface of the base;

a one-piece bolt having first and second opposing edges, a first ridge extending along the first edge and shaped to fit within the first groove, a second ridge extending along the second edge and shaped to fit within the second groove, whereby the bolt is slidable back and forth along the base channel when its first and second ridges are engaged within the first and second grooves, respectively, the bolt having a first surface and a second surface, wherein an integral handle projects from the first surface of the bolt, the second surface of the bolt being positioned opposite the first surface of the bolt and defining a bolt channel having an integral bumper projecting from the second surface; and two connectors, each shaped to fit within a corresponding one of the at least two openings and adapted to secure the base to a supporting surface, each of the connectors having a head that projects above the inner surface of the base into the bolt channel, the heads of the connectors defining a limited space therebetween, whereby the bumper is constrained to remain within the limited space as the bolt slides back and forth along the base channel.

4. The improved surface bolt of claim 3, wherein both the bolt and the base channel are made from plastic.

5. An improved surface bolt consisting essentially of:

a) a one-piece base channel having a base with first and second opposing edges, a first sidewall extending along the first edge, and a second sidewall extending along the second edge, the base having an inner surface between the first and second sidewalls, the first sidewall having a lip that overhangs the base and defines a first groove between the base and the lip of the first sidewall, and the second sidewall having a lip that overhangs the base and defines a second groove between the base and the lip of the second sidewall, the base defining at least two openings, each extending from the inner surface of the base through the base to an outer surface of the base;

b) a one-piece bolt having first and second opposing edges, a first ridge extending along the first edge and shaped to fit within the first groove, a second ridge extending along the second edge and shaped to fit within the second groove, whereby the bolt slides back and forth along the base channel with its first and second ridges engaged within the first and second grooves, respectively, the bolt having a first surface and a second surface, wherein an integral handle projects from the first surface of the bolt, the second surface of the bolt being positioned opposite the first surface of the bolt and defining a bolt channel having an integral bumper projecting from the second surface; and c) two connectors within a corresponding one of the at least two openings and securing the base of the base channel to a supporting surface, each of the connectors having a head projecting above the inner surface of the base into the bolt channel, the heads of the connectors defining a limited space therebetween, whereby the bumper is constrained to remain within the limited space as the bolt slides back and forth along the base channel.

6. The improved surface bolt of claim 5, wherein both the bolt and the base channel are made from plastic.

* * * * *